US010408054B2

(12) United States Patent
Paul

(10) Patent No.: US 10,408,054 B2
(45) Date of Patent: Sep. 10, 2019

(54) METHOD FOR ESTIMATING STRESS MAGNITUDE

(71) Applicant: CONOCOPHILLIPS COMPANY, Houston, TX (US)

(72) Inventor: Pijush K. Paul, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 15/247,418

(22) Filed: Aug. 25, 2016

(65) Prior Publication Data

US 2017/0058668 A1 Mar. 2, 2017

Related U.S. Application Data

(60) Provisional application No. 62/209,577, filed on Aug. 25, 2015.

(51) Int. Cl.
*E21B 49/00* (2006.01)
*E21B 43/26* (2006.01)
(Continued)

(52) U.S. Cl.
CPC ..... *E21B 49/00* (2013.01); *E21B 43/26* (2013.01); *E21B 47/02* (2013.01); *E21B 49/02* (2013.01); *E21B 49/087* (2013.01)

(58) Field of Classification Search
CPC ..... E21B 43/26; E21B 47/02; E21B 49/00; E21B 49/02; E21B 49/087
See application file for complete search history.

(56) References Cited

U.S. PATENT DOCUMENTS

2006/0100837 A1* 5/2006 Symington ..... E21B 49/006 703/10
2006/0153005 A1 7/2006 Herwanger
(Continued)

FOREIGN PATENT DOCUMENTS

WO 2009079404 6/2009
WO 2012103063 A2 8/2012
WO 2013172813 11/2013

OTHER PUBLICATIONS

Unknown, "Fracture mechanics", Jun. 20, 2017, pp. 1-5.*
(Continued)

*Primary Examiner* — Mischita L Henson
(74) *Attorney, Agent, or Firm* — ConocoPhillips Company

(57) ABSTRACT

Unconventional reservoirs need hydraulic stimulation in all the wells to enhance permeability for an economic production, which accounts for a large part of the well expenditure. However, lack of accurate stress information leads to incorrect selection of producing intervals, which transforms to under-performance in production. An analytical solution is optimized to determine the principal horizontal stresses by integrating the concept of uniaxial elasticity and frictional equilibrium. The software tool allows estimation of the continuous solutions of stresses based on the frictional strength concept. A more realistic considerations of rock rheology in stress estimation and better estimate principal horizontal stress magnitude in the earth crust help in planning and executing hydraulic stimulation operation. The stress estimate also aids in planning important parameters to drill and complete the wells successfully.

14 Claims, 11 Drawing Sheets

(51) Int. Cl.

| | |
|---|---|
| ***E21B 47/02*** | (2006.01) |
| ***E21B 49/02*** | (2006.01) |
| ***E21B 49/08*** | (2006.01) |

(56) References Cited

U.S. PATENT DOCUMENTS

| | | | |
|---|---|---|---|
| 2011/0182144 | A1 | 7/2011 | Gray |
| 2013/0081804 | A1 | 4/2013 | Sinha et al. |
| 2015/0168597 | A1 | 6/2015 | Bai |

OTHER PUBLICATIONS

Carrie Hatcher, "Horizontal Stress Modeling", Feb. 4, 2016, HXR Drilling Services, pp. 1-5.*

Weijermars, R., Analytical Stress Functions applied to Hydraulic Fracturing: Scaling the Interaction of Tectonic Stress and Unbalanced Borehole Pressures, Jun. 26, 2011, American Rock Mechanics Association, 45th US Rock Mechanics / Geomechanics Symposium, ARMA 11-598, pp. 1-13.*

International Search Report for related application App. No. PCT/U52016/048728, dated Nov. 18, 2016.

* cited by examiner

METHOD FOR ESTIMATING STRESS MAGNITUDE

PRIOR RELATED APPLICATIONS

This application is a non-provisional application which claims benefit under 35 USC § 119(e) to U.S. Provisional Application Ser. No. 62/209,577 filed Aug. 25, 2015, entitled "METHOD FOR ESTIMATING STRESS MAGNITUDE," which is incorporated herein in its entirety.

FIELD OF THE DISCLOSURE

The disclosure generally relates to a method for more accurately calculating the horizontal stresses in a reservoir, and more particularly to methods of estimating horizontal stress that takes both the frictional strength and realistic elasticity into consideration.

BACKGROUND OF THE DISCLOSURE

In-situ stress fields and pore pressures are crucial for analyzing and predicting geomechanical issues encountered in the oil and gas industry. Drilling, completion, wellbore stability, fracturing the formation, etc. involve significant financial investment. Reservoir stress changes occurring during production, such as reservoir compaction, surface subsidence, formation fracturing, casing deformation and failure, sanding, or reactivation of faults may cause great loss. Therefore, better knowledge of the in-situ stress fields helps to reduce the losses and also contributes to better prediction and planning of the drilling and completion.

In general, the in-situ stress fields may be represented as a second-rank tensor with three principal stresses, namely the vertical stress ($S_v$), the minimum horizontal stress ($S_h$) and the maximum horizontal stress ($S_H$). The vertical stress may be estimated from an integral of the density log, while the minimum horizontal stress may be estimated using a poroelastic equation or a frictional equilibrium equation.

Analytical and/or semi-analytical methods are used to characterize present day stress states in the sub-surface. These techniques are popular because they provide reasonable estimates of the stress distribution around and along the wellbore without building and solving a numerical grid, which saves a lot of time. Further, these techniques require only limited number of input parameters, which can be directly or indirectly observed by wireline tools or by specific tests done on core samples.

Although helpful, the assumptions and simplifications applied in these analytical solutions are not valid for all cases, and may lead to erroneous estimation of horizontal stresses. As an example, plain-strain solutions assume earth to be an elastic, homogenous and isotropic medium. Frictional equilibrium based calculations assume frictional strength of the faults as the limiting factors for the stresses, and allows stress estimations at limited number points with wellbore failures.

There is also the concern that in unconventional reservoirs, where the rock properties are not in conformation with already established models, reliable estimation of horizontal stresses for non-elastic rocks may be difficult to obtain.

For example, currently available analytical techniques to estimate horizontal stresses in the earth's crust use unrealistic assumptions and material models. Most of the analytical solutions in the industry assume a uniaxial, elastic, homogeneous and isotropic earth medium, which is not valid in the presence of structures such as faults, folds and also in the presence of plastic rocks such as ductile shale, etc.

Another approach uses frictional strength of the faults as the limiting case for stress estimation. Assumptions associated with this technique are more realistic than solutions with elasticity. However, the stress estimation based on this technique requires more input parameters. Stress calculations can be done at specific points along the wellbore where wellbore failures, such as breakouts and drilling-induced tensile fracture, are observed. This technique fails to provide stress estimation in the absence of wellbore failures. Also, this approach uses manual point based calculations that allow stress estimation only at a limited number of points and fails to produce a continuous estimation of stress along the borehole.

Analytical solutions for stress estimation for non-elastic medium are not developed because of the complexity and multi-dimensional nature of the problem. In fact, any non-elastic solution will need various assumptions. Also, this type of solution is only possible for simplified non-elastic materials.

As an example, most of the oil industry uses a plain-strain model to define a stress state, as illustrated below in Equation (1). The plain-strain approach assumes an elastic, homogenous and isotropic earth. It also assumes that the vertical stress (Sv) is applied instantaneously and that no other source of stress exists.

$$S_{Hmax} - \alpha P_p = S_{hmin} - \alpha P_p = (S_v - \alpha P_p)\left(\frac{v}{1-v}\right) \tag{1}$$

where $P_p$ is the pore pressure, α is Biot's coefficient, $S_{H\,max}$ and $S_{h\,min}$ are horizontal stresses, and v is Poisson's ratio.

To account for existing tectonic stresses on the earth, Equation (1) is modified with stress and strain offset in the direction of tectonic forces. Equations (2) and (3) below represent the plain-strain models with stress and strain offsets respectively.

$$\begin{aligned} S_{Hmax} - \alpha P_p &= \left(\frac{v}{1-v}\right)(S_v - \alpha P_p) + (S_y - \alpha P_p) \\ S_{hmin} - \alpha P_p &= \left(\frac{v}{1-v}\right)(S_v - \alpha P_p) + (S_x - \alpha P_p) \end{aligned} \tag{2}$$

where $S_y$ and $S_x$ are stress offsets due to tectonic movements in maximum and minimum horizontal stress directions respectively.

$$\begin{aligned} S_{Hmax} - \alpha P_p &= \left(\frac{v}{1-v}\right)(S_v - \alpha P_p) + \frac{E}{(1-v^2)}(\varepsilon_H + v\varepsilon_h) \\ S_{hmin} - \alpha P_p &= \left(\frac{v}{1-v}\right)(S_v - \alpha P_p) + \frac{E}{(1-v^2)}(\varepsilon_h + v\varepsilon_H) \end{aligned} \tag{3}$$

where E is static Young's modulus, and $\varepsilon_H$ and $\varepsilon_h$ are tectonic strains in maximum and minimum horizontal stress directions respectively.

Recently, Equation (3) was modified to consider transverse anisotropy in a shaly medium, which constitutes most of the non-conventional reservoirs. Equation (4) shows a plain-strain model for a transversely anisotropic medium.

$$S_{Hmax} - \alpha_h P_p = \left(\frac{E_h}{E_v}\right)\left(\frac{v_v}{1 - v_h}\right)(S_v - \alpha_v P_p) + \frac{E_h}{(1 - v_h^2)}(\varepsilon_H + v_h \varepsilon_h) \quad (4)$$

$$S_{hmin} - \alpha_h P_p = \left(\frac{E_h}{E_v}\right)\left(\frac{v_v}{1 - v_h}\right)(S_v - \alpha_v P_p) + \frac{E_h}{(1 - v_h^2)}(\varepsilon_h + v_h \varepsilon_H)$$

where subscripts h and v represent the values in vertical and horizontal directions respectively.

Another approach to define stress states in the earth is the frictional equilibrium approach used by GMI in the SFIB tool kit (geomi.com/software/SFIB.php). This approach assumes that the earth is full of discontinuities (faults and fractures) and these discontinuities control the maximum value of stress a block of earth can hold. It uses borehole failures such as breakouts and tensile fractures to define the stress state. This approach is the other end of the spectrum than a plain-strain model. The equation of frictional equilibrium state is shown in Equation (5).

$$\frac{\sigma_1}{\sigma_3} = \frac{S_1 - \alpha P_p}{S_3 - \alpha P_p} \leq \left[(\mu^2 + 1)^{1/2} + \mu\right]^2 \quad (5)$$

where $S_1$ and $S_3$ are the maximum and minimum principal stresses, and $\mu$ is the coefficient of frictional strength of faults and fractures in the medium.

Plain-strain model in the above forms (Equations 1 to 4) are used extensively in the oil industry, but fail to account for the fundamental reality that the earth is not elastic and homogenous. The frictional equilibrium approach (Equation 5) is a better approach to get the stress magnitudes in the presence of borehole failures and to get the maximum threshold of stresses in the earth. However, it doesn't explain the stress state before the borehole failures, or how stresses are affected by the non-elastic nature of the rock.

Therefore, there is the need for a better method of estimating horizontal stress that takes both the frictional strength and realistic elasticity into consideration.

SUMMARY OF THE DISCLOSURE

A new tool and workflow to estimate principal horizontal stress magnitude in the earth crust is provided. The analytical solution is optimized to determine the principal horizontal stresses by integrating the concept of uniaxial elasticity and frictional equilibrium. The software tool allows estimation of the continuous solutions of stresses based on the frictional strength concept.

A second part of this tool integrates elastic and frictional strength solutions to provide an optimum solution with uncertainties at depths along the borehole. This tool allows including large number of points with wellbore failure for analysis in a shorter time frame.

In the first step of this method, an existing solution is used to provide a short-term solution, where the concept of friction equilibrium is used to estimate the horizontal stress and sub-surface rock properties.

The second step then uses an elasticity assumption to estimate the horizontal stress for a uniaxial case.

The software code then compares the uniaxial results to the results of the frictional equilibrium to determine the effect of tectonic forces and local variations in stresses due to faults and discontinuities. This method uses a percentile filtering concept to estimate the scaling factor to provide the optimum integrated solution for horizontal stresses. Final results of horizontal stresses are a mixture of solutions from the first and second parts. This method considers the discontinuities in the earth crust (the first part) and the stress accumulated in the earth before any wellbore failure.

In addition, an alternative theory is invented to obtain an optimum solution by integrating elastic stress solution with the frictional equilibrium solution. This method uses a function of uniaxial compressive strength to integrate these two solutions as shown below. In this case functions f1 and f2 below are independent to each other and determined by correlating difference between the uniaxial stress solutions to the frictional equilibrium solution.

$$S_H - \alpha P_p = k(S_v - \alpha P_p) + f1(\mathrm{UCS}) \quad (6)$$

$$S_h - \alpha P_p = k(S_v - \alpha P_p) + f2(\mathrm{UCS}) \quad (7)$$

wherein functions $f1$ and $f2$ are independent, UCS is uniaxial compressive strength, Sv is vertical stress, and $P_p$ is pore pressure, $S_h$ is minimum horizontal stress, $S_H$ is maximum horizontal stress, $\alpha$ is Biot's coefficient and $$0 < k = \frac{v}{1 - v} < 1.$$

The first part of the equations provides a uniaxial stress solution for an elastic behavior of the material and then non-elastic behavior is superimposed to obtain an optimum solution. Uniaxial compressive strength (UCS) is the property mostly linked to the micro- and macroscopic compressive failure of the rock and a function related to UCS should be able to define the non-elastic behavior of the total stress. Another advantage of this new concept is the availability of continuous UCS logs generated from sonic logs and calibrated using lab measurements. This continuity in UCS log provides a basis to integrate uniaxial stress solution generated using sonic logs with the frictional equilibrium solution available only in the limited points.

The practical importance of these methods are that they allow a petroleum engineer to plan and execute productive stimulation and drilling operations in unconventional reservoirs. Unconventional reservoirs need hydraulic stimulation in all the wells to enhance permeability for an economic production, which accounts for a large part of the well expenditure. However, lack of accurate stress information leads to incorrect selection of producing intervals, which transforms to under-performance in production. The disclosed method provides more realistic considerations of rock rheology in stress estimation, and the better results of which help in planning and executing hydraulic stimulation operation. The stress estimate also aids in planning important parameters to drill and complete the wells successfully.

The invention includes and one or more of the following embodiments, in any combination(s) thereof:

A method of calculating principal horizontal stresses along a wellbore into a subterranean formation, comprising the steps of: a) obtaining physical properties of said wellbore, said physical properties comprising one or more of: density log, compressive and tensile rock strength, frictional strength of any discontinuity, wellbore path, position and type of wellbore failure observed in wellbore images, and mud weight; b) calculating a first horizontal stress based on at least one of said physical properties based on an assumption of frictional forces in the earth; c) calculating a second horizontal stress based on an assumption of a uniaxial elastic earth crust; d) comparing the first horizontal stress with the second horizontal stress; e) performing percentile filtering to assign a scaling factor; and f) calculating a third horizontal stress by applying said scaling factor based on both the frictional forces and the uniaxial elastic earth assumptions.

A method as described, wherein said first horizontal stress is estimated by a first algorithm that includes equation (1):

$$S_{Hmax} - \alpha P_p = S_{hmin} - \alpha P_p = (S_v - \alpha P_p)\left(\frac{v}{1-v}\right) \quad (1)$$

where $P_p$ is the pore pressure, $\alpha$ is Biot's coefficient, $S_{H\,max}$ and $S_{h\,min}$ are horizontal stresses, Sv is vertical stress, and v is Poisson's ratio.

A method as described, wherein said first algorithm includes a failure criterion selected from Mohr-Coulomb criterion, modified lade criterion, Drucker Prager criterion, and Hoek criterion.

A method as described, wherein said second horizontal stress is calculated by a second algorithm that includes equation (2):

$$S_{Hmax} - \alpha P_p = \left(\frac{v}{1-v}\right)(S_v - \alpha P_p) + (S_y - \alpha P_p) \quad (2)$$

$$S_{hmin} - \alpha P_p = \left(\frac{v}{1-v}\right)(S_v - \alpha P_p) + (S_x - \alpha P_p)$$

where $S_y$ and $S_x$ are stress offsets due to tectonic movements in maximum and minimum horizontal stress directions respectively.

A method as described, wherein said third horizontal stress is calculated by a third algorithm that integrates the first and second algorithm, said third algorithm includes equation (3):

$$S_{Hmax} - \alpha P_p = \left(\frac{v}{1-v}\right)(S_v - \alpha P_p) + \frac{E}{(1-v^2)}(\varepsilon_H + v\varepsilon_h) \quad (3)$$

$$S_{hmin} - \alpha P_p = \left(\frac{v}{1-v}\right)(S_v - \alpha P_p) + \frac{E}{(1-v^2)}(\varepsilon_h + v\varepsilon_H)$$

where E is static Young's modulus, and $\varepsilon_H$ and $\varepsilon_h$ are tectonic strains in maximum and minimum horizontal stress directions respectively.

A non-transitory machine-readable storage medium, which when executed by at least one processor of a computer, performs the steps of the method(s) described herein.

A method of calculating an optimum continuous stress solution along a wellbore into a subterranean formation, comprising the steps of: a) estimating a vertical stress and sub-surface rock properties; b) performing continuous elastic stress solution based on plain-strain elastic solution using sonic logs obtained from said wellbore; c) performing stationed frictional equilibrium solution at the locations of compressive and tensile borehole failure; d) performing either of the following continuous stress solutions (1) defining polynomial functions based on co-existing solutions, or (2) defining uniaxial compressive strength; and e) comparing results from step d) with existing data to determine whether optimum continuous stress solution has been reached.

Any method as described herein, wherein in the comparing step the optimum continuous stress solution is reached when the difference between the results is less than 10%.

A method as described, wherein further comprising repeating steps the final method steps until an optimum continuous stress solution has been reached.

A non-transitory machine-readable storage medium which upon execution at least one processor of a computer to perform the steps of one or more of the methods described herein.

A method of determining stresses in a reservoir, said method comprising: a) estimating horizontal stresses and sub-surface rock properties using friction equilibrium equations; b) estimating horizontal stresses using uniaxial elasticity assumption equations; c) comparing results of step i and ii) to determine the effect of tectonic forces and local variations in stresses due to faults and discontinuities using percentile filtering to estimate a scaling factor; d) applying said scaling factor to obtain an optimum integrated solution for horizontal stresses.

A method as described, wherein the integration uses:

$$S_H - \alpha P_p = k(S_v - \alpha P_p) + f1(\mathrm{UCS})$$

$$S_h - \alpha P_p = k(S_v - \alpha P_p) + f2(\mathrm{UCS}),$$

wherein functions f1 and f2 are independent, UCS is uniaxial compressive strength, Sv is vertical stress, and $P_p$ is pore pressure, $S_h$ is minimum horizontal stress, $S_H$ is maximum horizontal stress, $\alpha$ is Biot's coefficient and $$0 < k = \frac{v}{1-v} < 1.$$

Any method described herein, including the further step of printing, displaying or saving the results of the method.

Any method described herein, further including the step of using said results in a reservoir modeling program to predict fracturing, production rates, total production levels, rock failures, faults, wellbore failure, and the like.

Any method described herein, further including the step of using said results to design and implement a hydraulic fracturing program.

As used herein, the "principal horizontal stress" in a reservoir refers to the minimum and maximum horizontal stresses of the local stress state at depth for an element of formation. These stresses are normally compressive, anisotropic and nonhomogeneous.

As used herein, "an assumption of frictional forces" refers to the assumption that the formation is not continuous and frictional forces exist between pre-existing planes of weakness, i.e. fault.

As used herein, "an assumption of a uniaxial elastic earth crust" refers to the assumption that deformation under the constraint that two out of three principal strains remain zero, i.e. the earth crust is elastic within certain range of strain/stress that is uniaxial, or simply put, the strain exists in only one direction.

As used herein "percentile filtering" refers to a mathematical filter that assigns each cell (or basic unit) in the output grid the percentile (0% to 100%) that the grid cell value is at within the cumulative distribution of values in a moving window centered on each grid cell. In other words, the percentile value becomes the result of the median filter at a center position of the cell.

As used herein, "scaling factor" refers to the factor empirically determined and assigned to the two solutions such that the combined results more accurately approximate reality.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| DFIT | Diagnostic fall of injection test |
| MDT | Modular formation dynamics tester |
| $S_{hmin}$ or $S_h$ | Least horizontal principal stress |
| $S_{Hmax}$ or $S_H$ | Maximum horizontal principal stress |
| Sv | Vertical stress |
| $P_p$ | Pore pressure |
| k | $0 < \frac{v}{1-v} < 1.$ |
| UCS | Uniaxial compressive strength |
| $S_y$ and $S_x$ | stress offsets due to tectonic movements in maximum and minimum horizontal stress directions respectively. |
| E | static Young's modulus |
| $\epsilon_H$ and $\epsilon_h$ | tectonic strains in maximum and minimum horizontal stress directions respectively |

DETAILED DESCRIPTION

Figure 6:
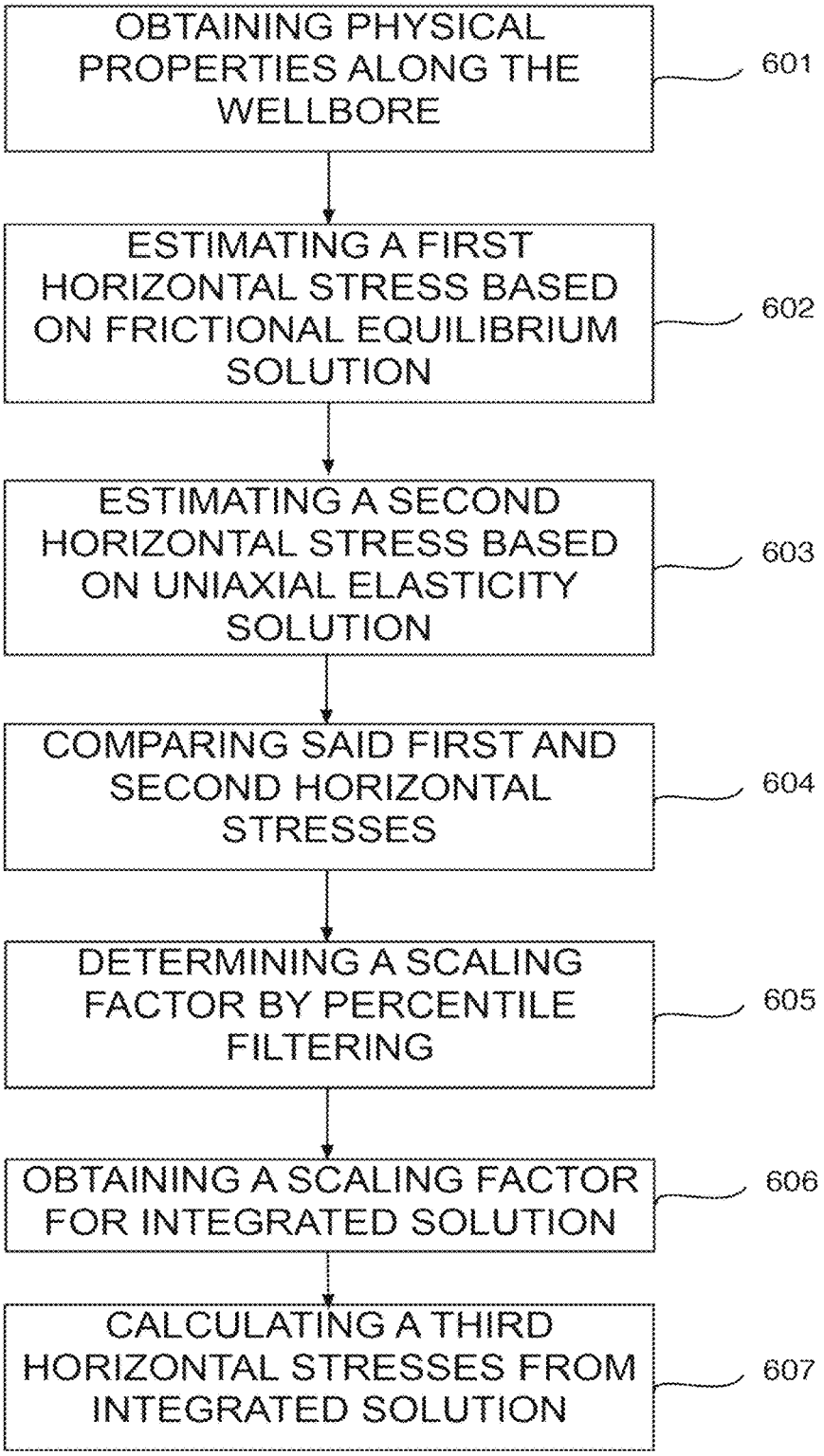
FIG. 6 shows the flow diagram of the disclosed method.

FIG. 6 illustrates the simplified flow chart of the disclosed method. The method disclosed herein combines the frictional equilibrium concept with the uniaxial, elasticity concepts.

The first step 601 is measuring and obtaining physical properties along the wellbore, including one or more of density log, compressive and tensile rock strength, frictional strength of the discontinuities, wellbore path, position and type of wellbore failure observed in wellbore images and mud weight. Of course, if this data is already available, one can proceed directly to step 602.

In step 602, these physical properties are used as input to the modified frictional equilibrium solution to obtain an approximation of a first horizontal stress. It is noted that the frictional equilibrium solution is preferably modified from the conventional ones so that the approximation is more accurate. However, conventional equations can also be used throughout.

In step 603, a modified uniaxial elasticity solution is used to obtain a second approximation of the horizontal stress. Similarly, the preferred modified uniaxial elasticity solution itself provides more accurate approximations than conventional ones.

In step 604, the results from the steps 602 and 603 are compared, where the difference would be a result of tectonic forces and local variation in stresses due to faults and discontinuities.

In step 605, by applying percentile filtering to the results in 604, a scaling factor for each datapoint in the image is obtained, such that the two solutions are combined to provide an optimum approximation of the horizontal stresses for a confined area.

Lastly, in step 607 the optimized integrated solution is used to calculate a final stress for this optimized integration, which considers the effects due to discontinuities in the earth crust, as well as the stress accumulated in the earth before any wellbore failure. Further research and experimentation are being conducted to develop a general power law material to estimate stress around the borehole, wherein limited input parameters are necessary.

Figure 5:
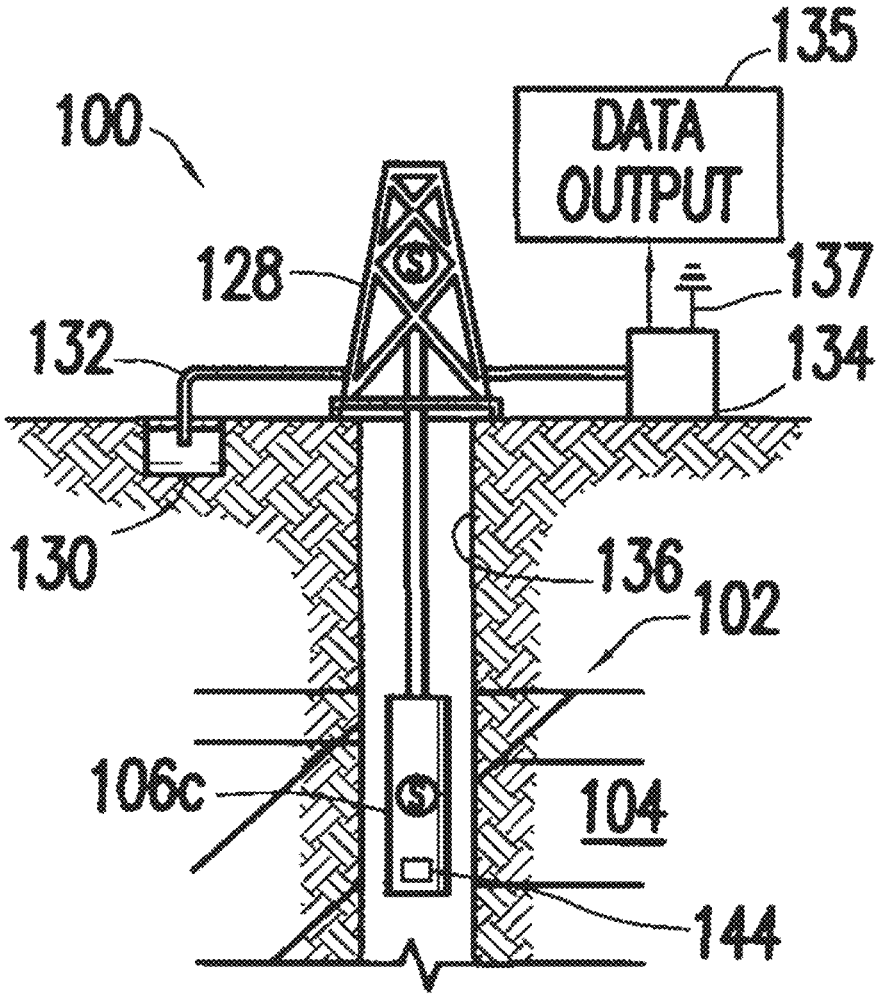
FIG. 5 illustrates a wireline tool collecting data in a wellbore.

In step 601, the physical properties along the wellbore are typically measured as illustrated in FIG. 5, which depicts a general wireline operation by a wireline tool 106*c* suspended by the rig 128 into the wellbore 136. The wireline tool 106*c* is used to gather and generate well logs, performing downhole tests and collecting samples for testing in a laboratory. Also the wireline tool 106*c* may be used to perform a seismic survey by having a, for example, explosive, radioactive, electrical or acoustic energy source that sends and/or receive signals to the surrounding subterranean formations 102 and fluids.

After collecting data, the wireline tool 106*c* may transmit data to the surface unit 134, which then generates data output 135 that is then stored or transmitted for further processing. The wireline tool 106*c* can be positioned at various depths in the wellbore 136 to collect data from different positions. Here S is one or more sensors located in the wireline tool 106*c* to measure certain downhole physical properties, such as porosity, permeability, fluid compositions, and other parameters of the oilfield operation. The sensors S can also detect the well path and provide information of the location and type of breakout or drilling induced tensile failure. Other parameters, such as mud weight, compressive and tensile rock strength in the formation, and frictional strength of any discontinuities, can be derived from the already collected data.

Failure Criteria.

The disclosed method used the Mohr-Coulomb failure criterion to determine whether a failure exists. However, other failure criteria may be used instead. These failure criteria are briefly discussed herein.

The general definition of rock failure refers to the formation of faults and fracture planes, crushing, and relative motion of individual mineral grains and cements. By default the failure criteria used in the disclosed method was the Mohr-Coulomb criterion. The Mohr-Coulomb failure criterion represents the linear envelope that is obtained from a plot of the shear strength of a material versus the applied normal stress. This relation is expressed as $$\tau=\sigma \tan \phi+c \tag{8}$$

where $\tau$ is the shear strength, $\sigma$ is the normal stress, c is the intercept of the failure envelope with the $\tau$ axis, and $\phi$ is the slope of the failure envelope. The quantity c is often called the cohesion and the angle $\phi$ is called the angle of internal friction. Compression is assumed to be positive in the following discussion. If compression is assumed to be negative, then $\sigma$ should be replaced with $-\sigma$.

If $\phi=0$, the Mohr-Coulomb criterion reduces to the Tresca criterion. On the other hand, if $\phi=90°$ the Mohr-Coulomb model is equivalent to the Rankine model. Higher values of $\phi$ are not allowed.

From Mohr's circle we have $$\sigma = \sigma_m - \tau_m \sin\phi;\ \tau = \tau_m \cos\phi \tag{9}$$

where $$\tau_m = \frac{\sigma_1 - \sigma_3}{2};\ \sigma_m = \frac{\sigma_1 + \sigma_3}{2} \tag{10, 11}$$

and $\sigma_1$ is the maximum principal stress and $\sigma_3$ is the minimum principal stress.

Therefore the Mohr-Coulomb criterion may also be expressed as $$\tau_m=\sigma_m \sin \phi+c \cos \phi \tag{12}$$

This form of the Mohr-Coulomb criterion is applicable to failure on a plane that is parallel to the $\sigma_2$ direction.

However, other failure criterion can also be used, such as modified lade, Drucker Prager, Hoek-Brown, etc., can be used. All of the failure criteria are based on "effective stresses" that are defined as total stress minus the product of Biot's coefficient and pore pressure ($\sigma_i=S_i-\alpha P_p$).

The Modified Lade criterion (ML) is a three-dimensional strength criterion expressed by $$\left(\frac{(I_1'')^3}{I_3''}\right) = 27 + \eta \tag{13}$$

where $$I_1''=(\sigma_1+S_a-P_p)+(\sigma_2+S_a-P_p)+(\sigma_3+S_a-P_p) \tag{14}$$

$$I_3''=(\sigma_1+S_a-P_p)(\sigma_2+S_a-P_p)(\sigma_3+S_a-P_p) \tag{15}$$

The two parameters, Sa and $\eta$, are used to describe the rock strength:

$$\eta = 4\cdot(\tan\phi)^2\left\{\frac{9-7\sin\phi}{1-\sin\phi}\right\} \tag{16}$$

$$S_a = \frac{c}{\tan\phi} \tag{17}$$

The angle $\phi$ is the friction angle in the Mohr-Coulomb failure criterion, and c is the cohesion.

The Hoek and Brown empirical failure criterion is represented by $$\sigma_1 = \sigma_3 + C_0\sqrt{m\frac{\sigma_3}{C_0} + s} \tag{18}$$

wherein m and s are constants that depend on the properties of the rock and on the extent to which it was broken before being subjected to the failure.

The circumscribed Drucker-Prager criterion is a pressure-dependent model for determining whether a material has failed or undergone plastic yielding, and is represented in terms of principal stresses by:

$$\sqrt{\tfrac{1}{6}[(\sigma_1-\sigma_2)^2+(\sigma_2-\sigma_3)^2+(\sigma_3-\sigma_1)^2]}=A+B(\sigma_1+\sigma_2+\sigma_3) \tag{19}$$

where the constants A and B are determined from experiments.

Figure 1A:
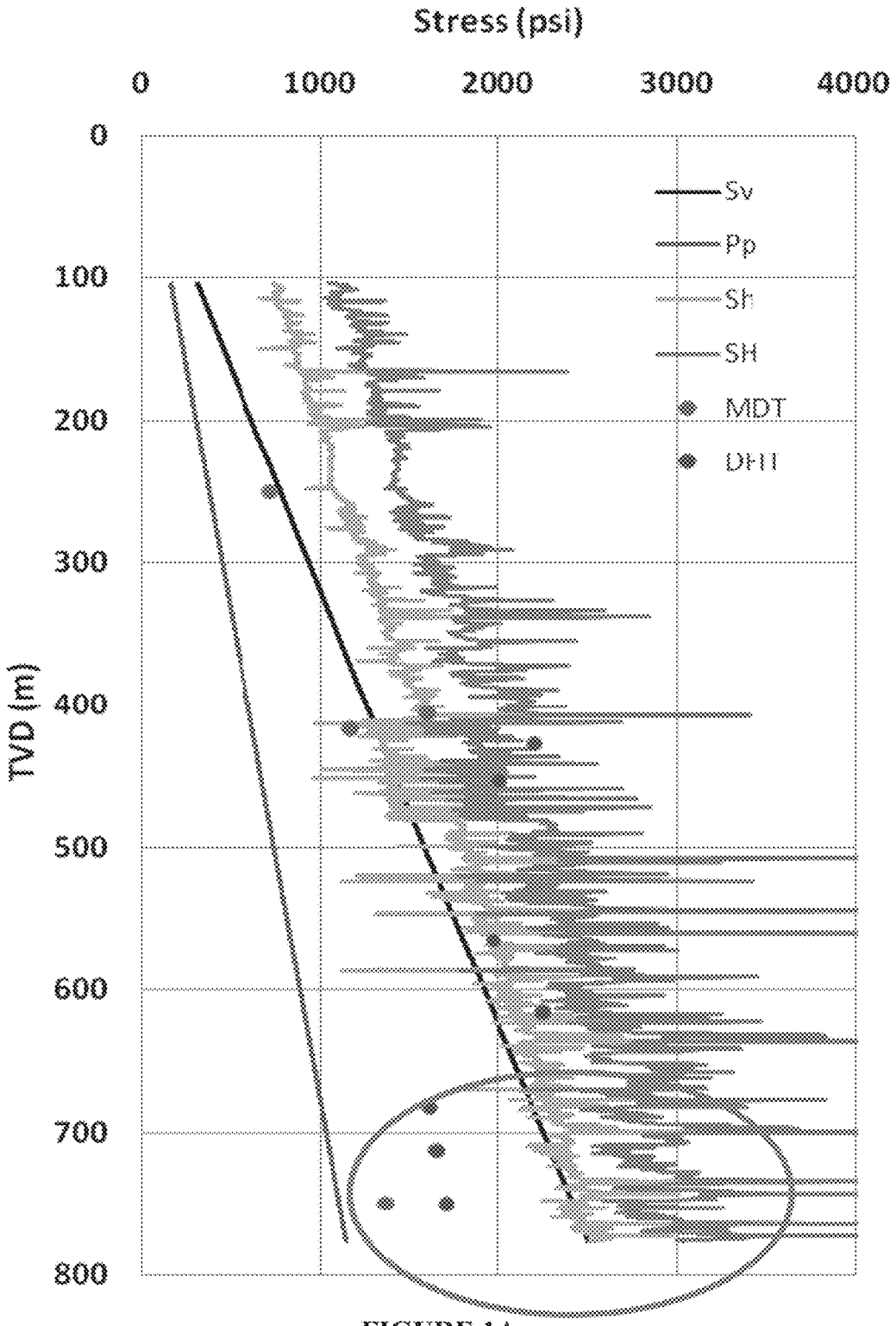
FIG. 1A-B shows the conventional approximation of horizontal stresses using the uniaxial elasticity and frictional equilibrium approaches.
Figure 1B:
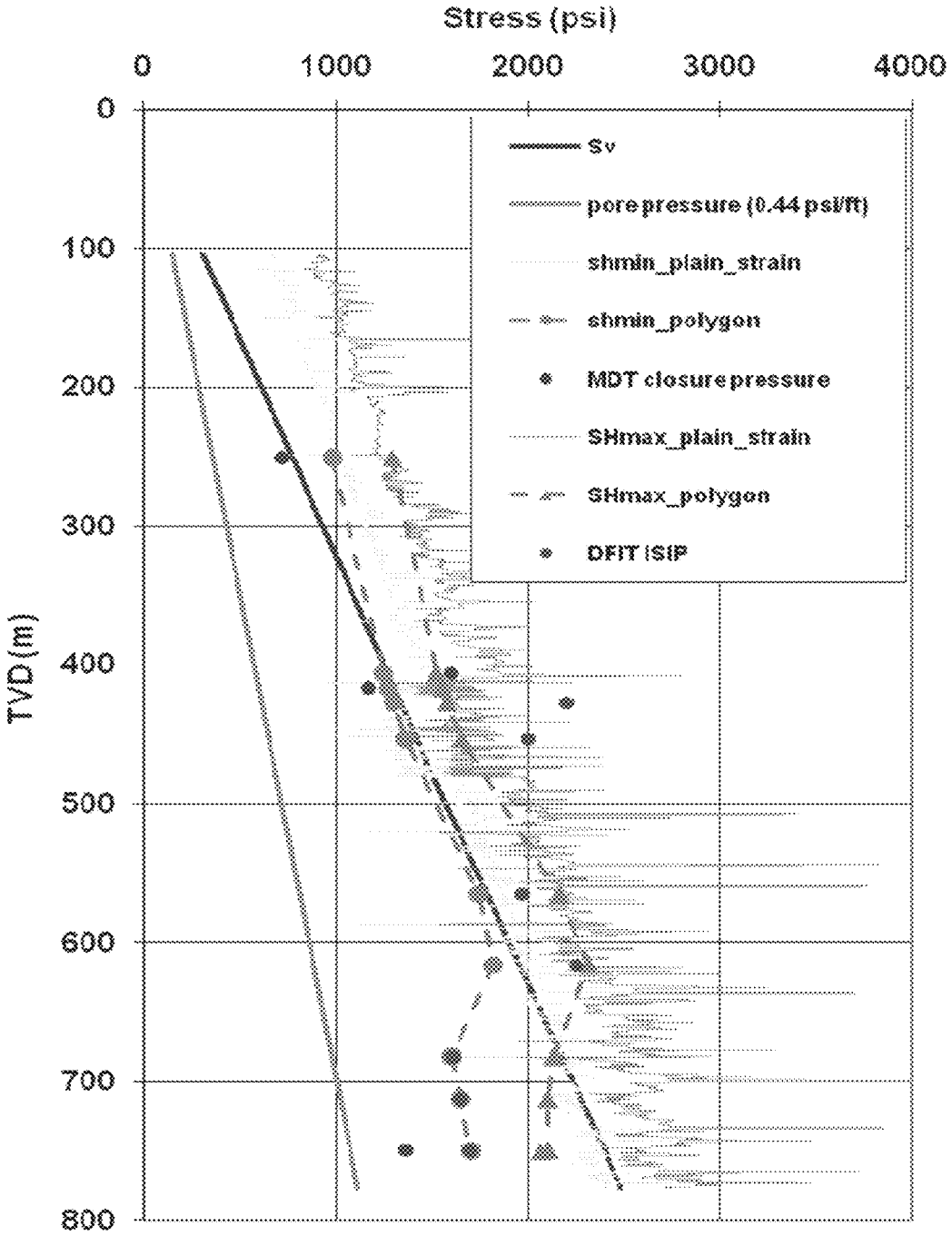

The following discussion will be based on the wellbore data from two wells in Australia. The vertical stress (Sv) and pore pressure ($P_p$) are measured through conventional techniques. Please refer to FIG. 1A-B, which shows the results of uniaxial and frictional equilibrium. $S_{h\ min}$ is the least horizontal principal stress, $S_{H\ max}$ is the maximum horizontal principal stress, MDT is the modular formation dynamic tester, and DFIT is the diagnostic fall off injection test. In FIG. 1A, the estimate based on poro-elastic strain concept deviates considerably from the actual stress. In FIG. 1B, the frictional equilibrium concept gives better result, but may miss the continuity in the earth because of its inherent assumption that faults exists.

Figure 2A:
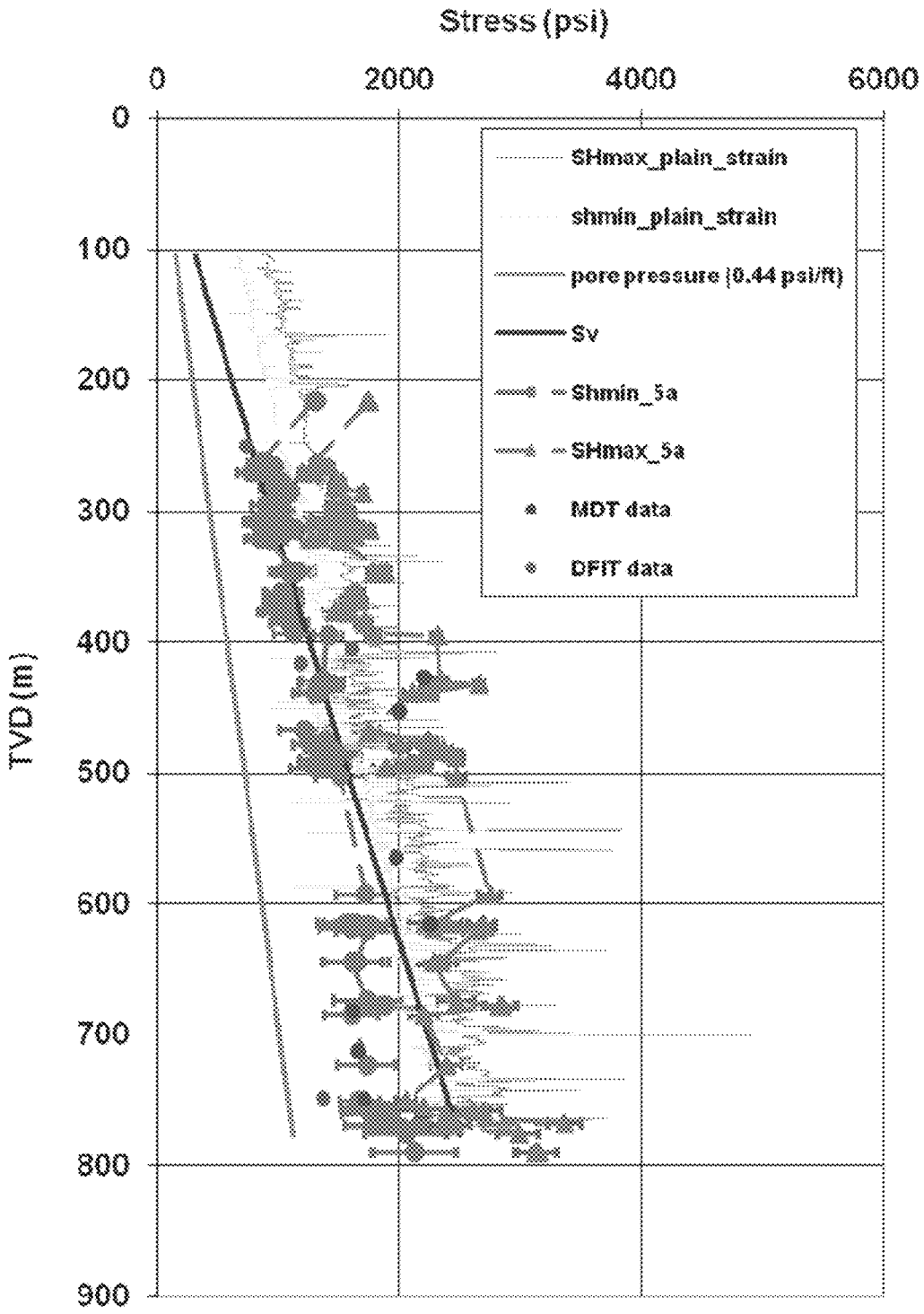
FIG. 2A-B shows additional examples of approximation using the modified frictional equilibrium solution of this disclosure.
Figure 2B:
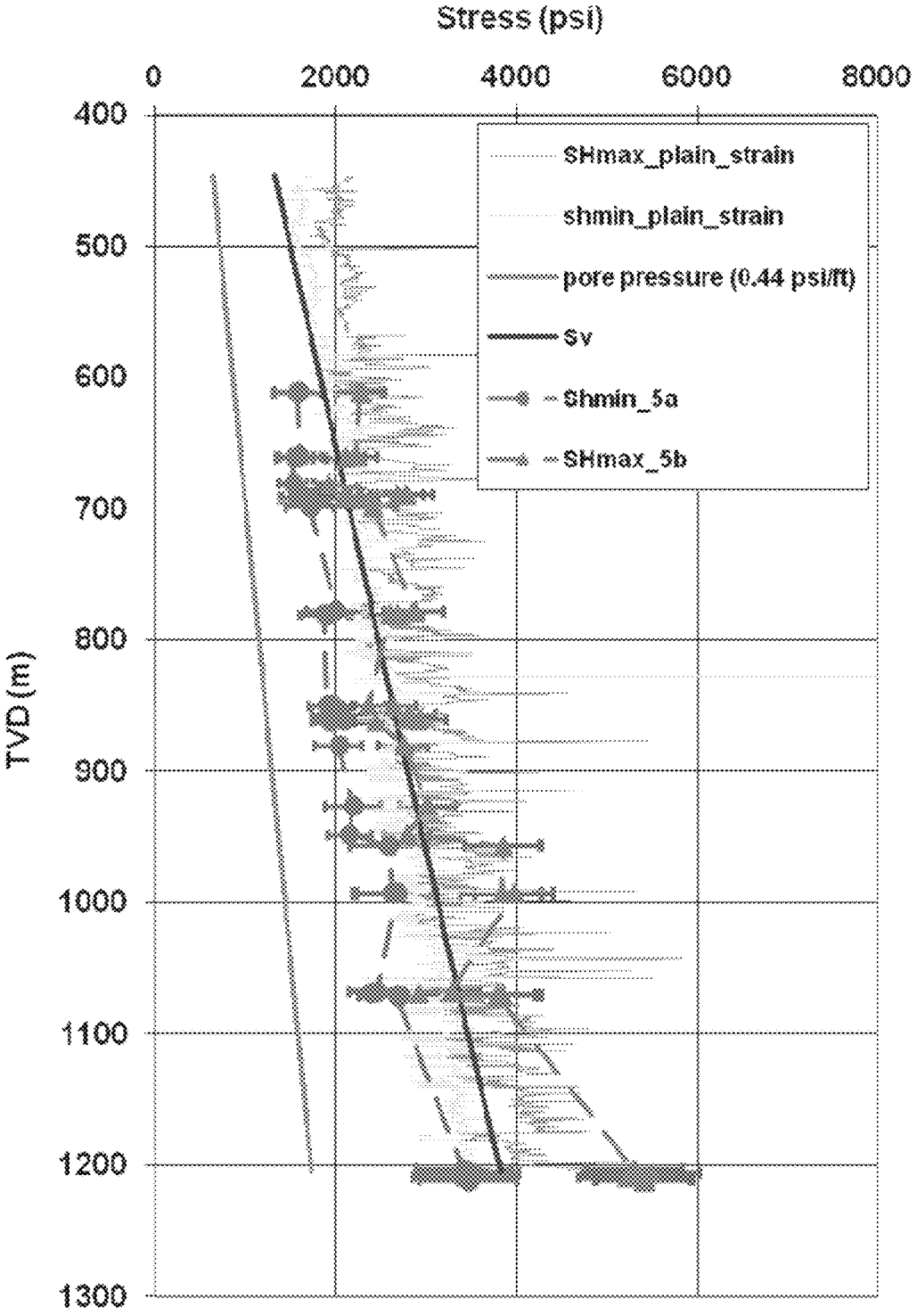

Additional results for different wells are illustrated in FIG. 2A-B, where it can been seen that the results of code 5*a* uses frictional concepts to obtain better results with more statistical points to define polynomial functions. Code 5*b* is specifically used for locations where the polynomial functions of continuous elastic solution cannot provide satisfactory results. Consequently, integrating code 5*a* and 5*b* is the final optimum continuous solution integrating both the elastic and frictional equilibrium concepts.

Figure 3A:
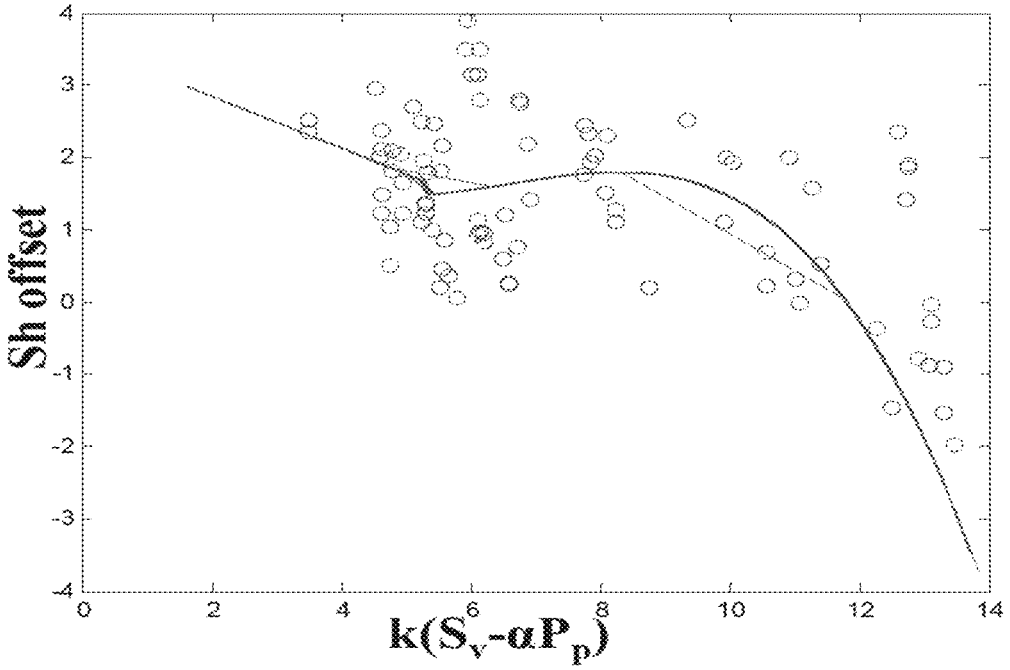
FIG. 3A-B shows the stress offset using percentile decomposition to define the scaling function between frictional equilibrium and uniaxial elastic solution along the borehole.
Figure 3A:
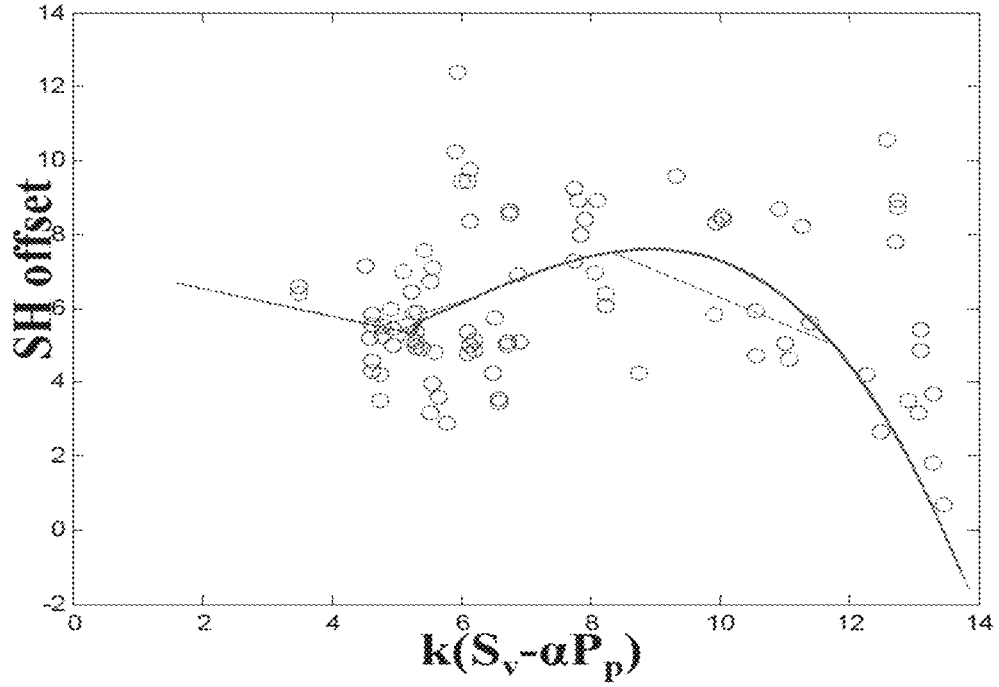
Figure 3B:
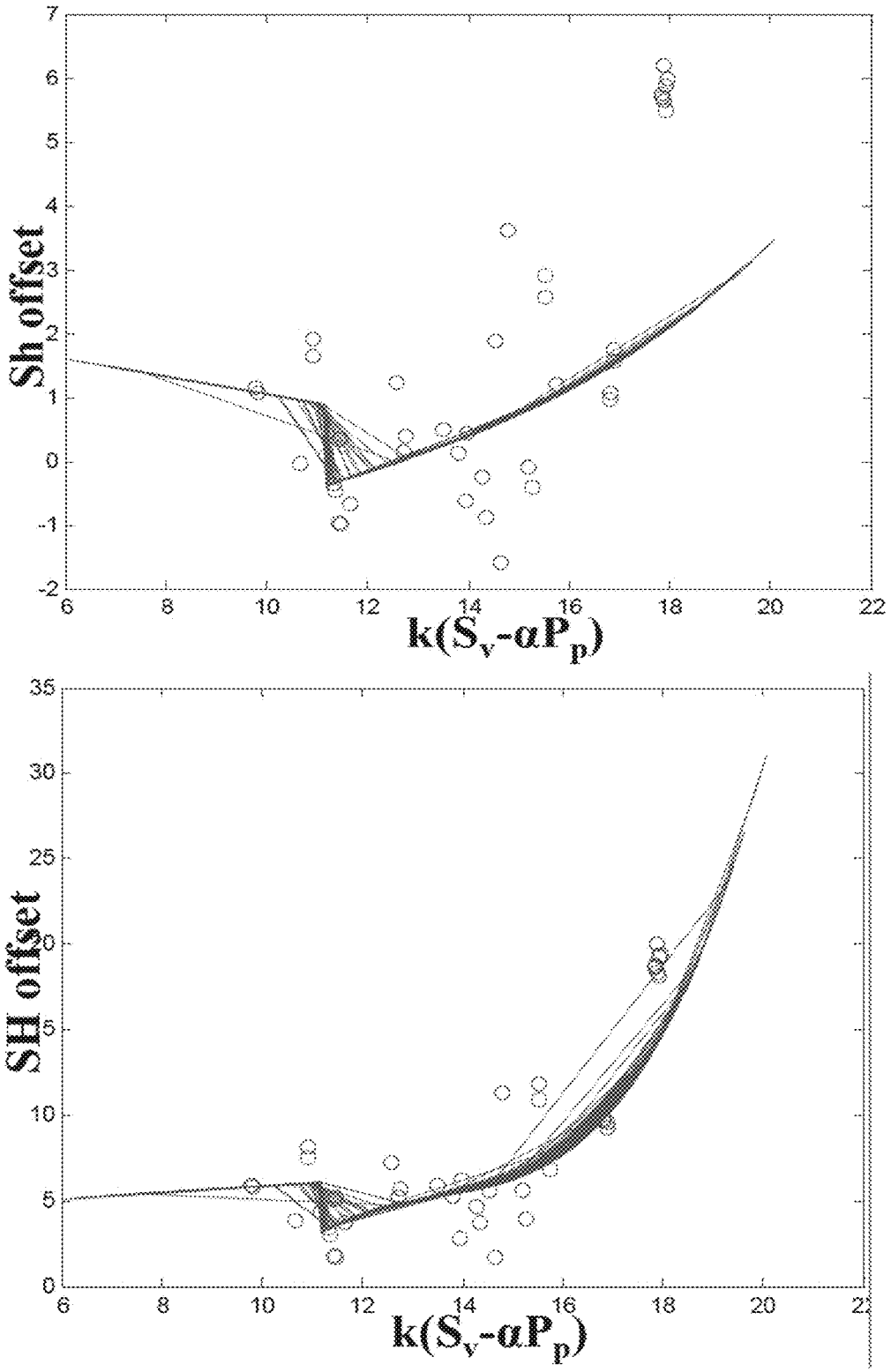

FIG. 3A-B shows the second part of the described method, in which percentile filtering is applied to define the scaling function between the frictional equilibrium and uniaxial elastic solution along the bore hole. The scaling function with the scaling factor k can be expressed as:

$$S_H-\alpha P_p=k(S_v-\alpha P_p)+\text{non elastic and tectonic stress effect} \tag{20}$$

$$S_h-\alpha P_p=k(S_v-\alpha P_p)+\text{non elastic and tectonic stress effect} \tag{21}$$

The tectonic stress is caused by geotectonic movement and is mainly in the horizontal direction similar to the crustal movement. The results measured in FIG. 3A shows the $S_h$ offset and $S_H$ offset by the disclosed method along one wellbore, and FIG. 3B shows another wellbore. It is seen that the disclosed method provides good approximation of the stress field. Here the non-elastic and tectonic stress effects are constants that are experimentally determined on a location-by-location basis.

Figure 4A:
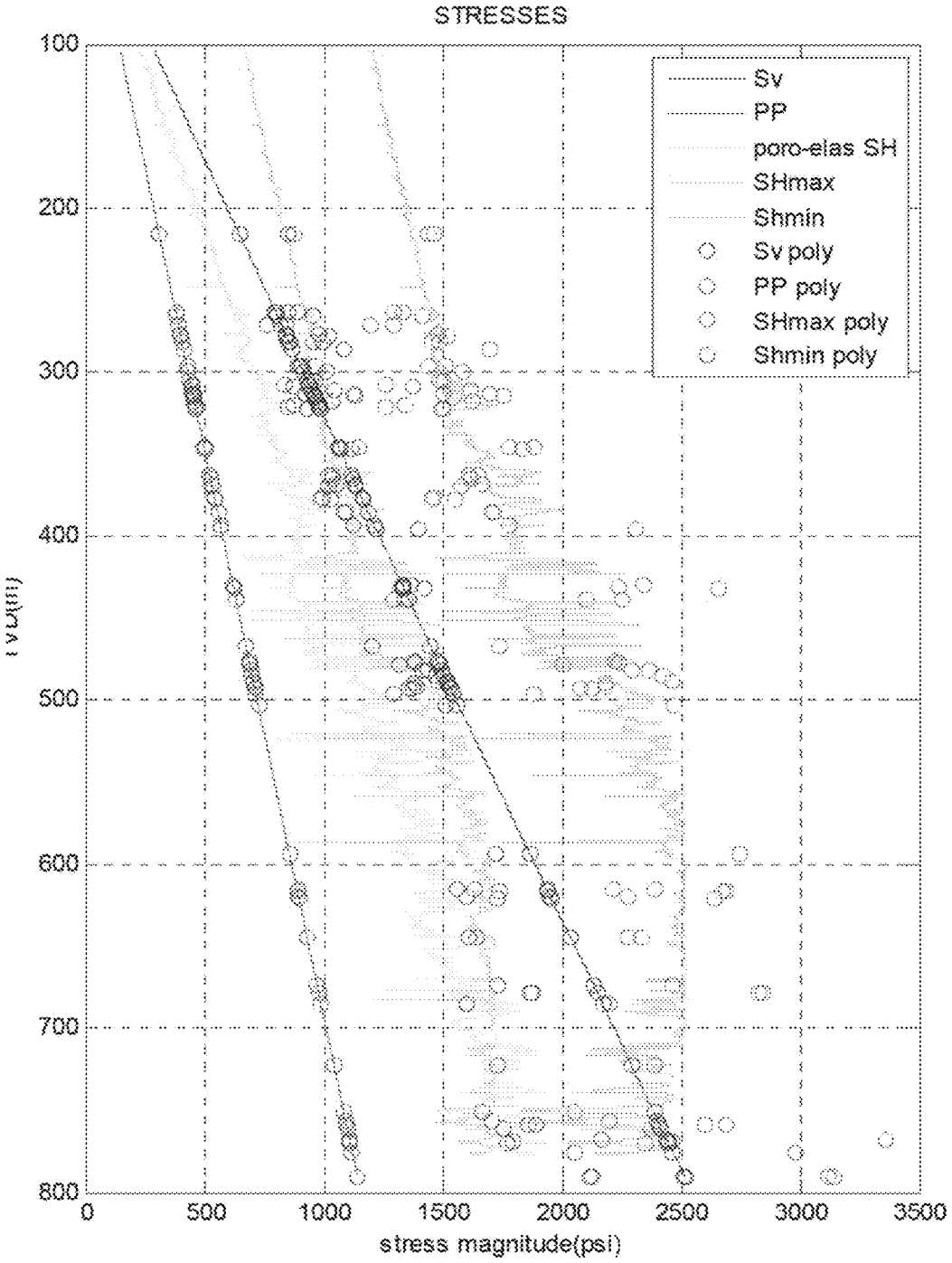
FIG. 4A-B shows continuous solutions of horizontal stresses that honor the results as shown in FIGS. 2A-B and 3A-B.
Figure 4B:
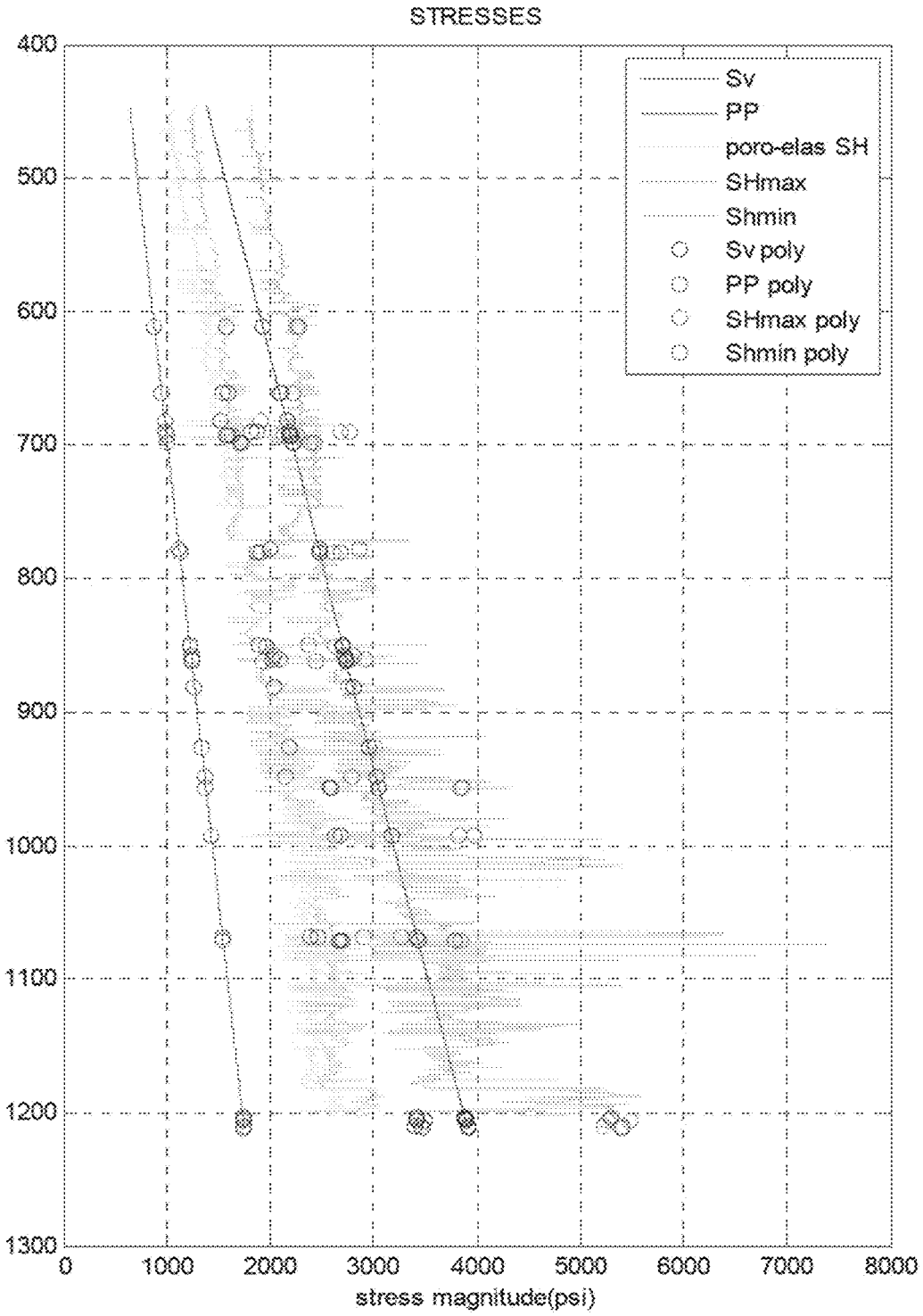

FIG. 4A-B shows integration of frictional equilibrium and uniaxial elastic solutions, as discussed in the second part of the disclosed method. The drawing shows continuous solutions of horizontal stresses for two wells that contain transition zones. Because the method considers both the uniaxial elasticity concept and the frictional equilibrium concept, and assigns an optimum scaling factor for each data point, and the results are much more consistent with actual field observation, especially when discontinuities exist in the underground formation.

Hardware for implementing the inventive methods may preferably include massively parallel and distributed Linux clusters, which utilize both CPU and GPU architectures. Alternatively, the hardware may use a LINUX OS, XML universal interface run with supercomputing facilities provided by Linux Networx, including the next-generation Clusterworx Advanced cluster management system. Another system is the Microsoft Windows 7 Enterprise or Ultimate Edition (64-bit, SP1) with Dual quad-core or hex-core processor, 64 GB RAM memory with Fast rotational speed hard disk (10,000-15,000 rpm) or solid state drive (300 GB) with NVIDIA Quadro K5000 graphics card and multiple high resolution monitors. Slower systems could also be used, because the processing is less compute intensive than for example, 3D seismic processing.

Figure 7:
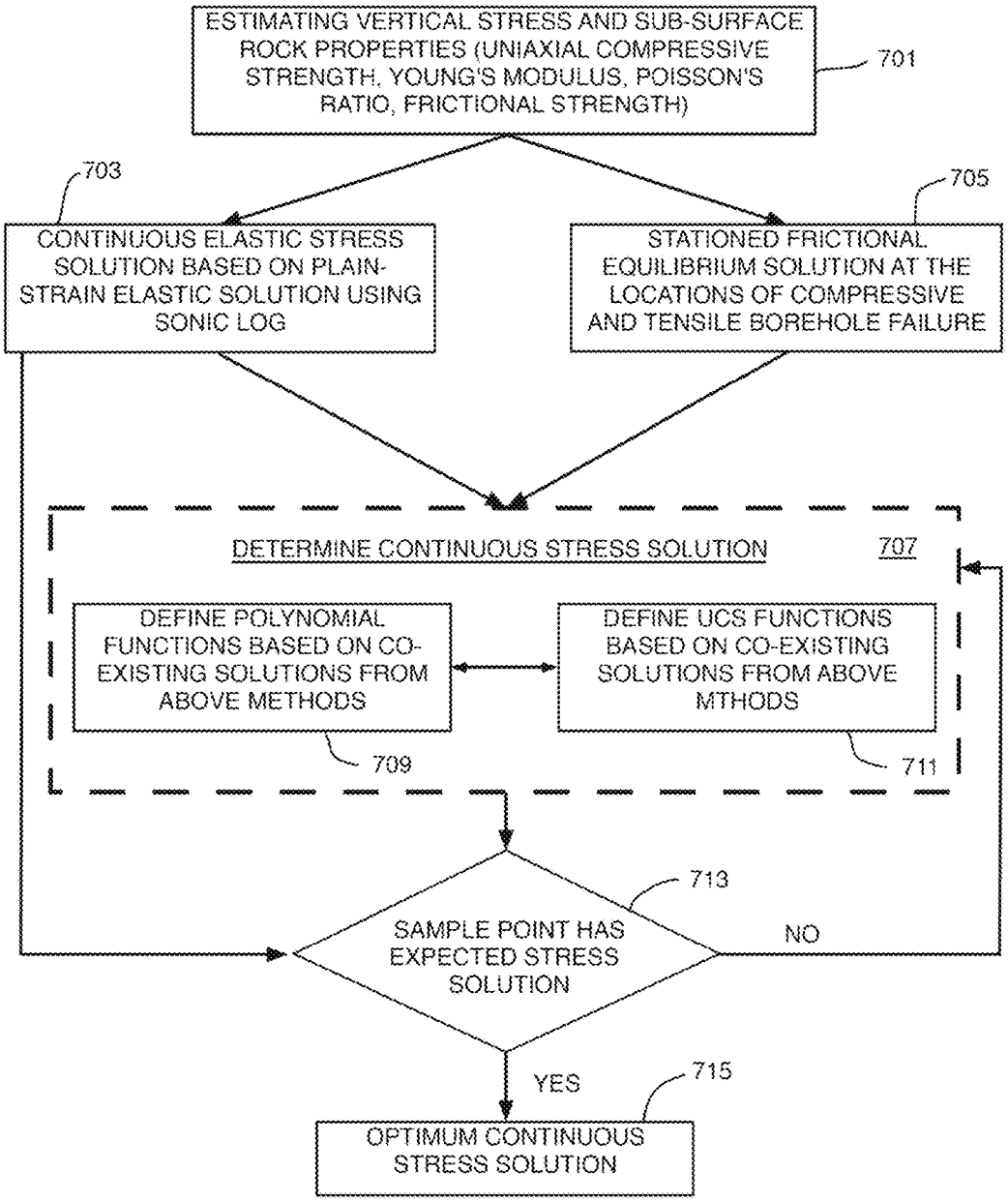
FIG. 7 shows an alternative flow diagram of the disclosed method.

FIG. 7 illustrates an alternative approach of integrating the continuous elastic stress solution and frictional equilibrium solution to obtain optimum continuous stress solution. In step 701, vertical stress and sub-surface rock properties, including uniaxial compressive strength, Young's modulus, Poisson's ratio, frictional strength, etc., are estimated from existing log data as a starting point.

In step 703, continuous elastic stress solution is performed based on plain-strain elastic solution using sonic logs obtained previously from the wellbore. Depending on the degree and extent of compressive/tensile borehole failure, the method can alternatively proceed by step 705 or directly to step 713, as discussed below.

In step 705, a stationed frictional equilibrium solution is performed, specifically at the locations of compressive and tensile borehole failure. The frictional equilibrium solution is particularly suitable for these locations because the elastic stress solution would not fit well.

Steps 703 and 705 are independently performed depending on the locations of compressive/tensile borehole failure present in the borehole. At the locations where the compressive/tensile failure occurs, step 705 is performed instead of 703. On the contrary, at the locations where there is no such failure, step 703 is performed. The results of both steps are superimposed (or integrated) together to represent the solution for the entire borehole. Therefore, if there is little or no compressive/tensile failure along the borehole, the results of step 703 proceed directly to step 713.

Next in step 707, the processor iteratively performs the solution between 709 that defines polynomial functions based on co-existing solutions from the method mentioned above, and 711 that defines UCS functions based on co-existing solutions from the method mentioned above.

In step 713, the results from step 707 are compared to already-acquired sample points. If the difference is greater than 10 or 15%, the system will determine that the solution is not optimal, therefore returning back to step 707 for further optimization by modifying the polynomial functions or the UCS functions. If the difference is equal to or less than 10 or 15%, then the system determines that the optimum continuous stress solution is obtained and ends the solution optimization. Higher (205) or lower (5%) cutoffs can be used if preferred or if dictated by reservoir geology or planning needs.

Step 713 can also receive the results directly from step 703, especially when there is no significant compressive and/or tensile borehole failure, and therefore skipping step 705.

Therefore, the method illustrated in FIG. 7 combines the advantages of both the elastic stress solution and the frictional equilibrium solution.

The results may be displayed in any suitable manner, including printouts, holographic projections, display on a monitor and the like. Alternatively, the results may be recorded to memory for use with other programs, e.g., reservoir modeling and the like.

The following references are incorporated by reference in their entirety for all purposes.

WO2009079404
WO2013172813

What is claimed is:

1. A method of calculating principal horizontal stresses along a wellbore into a subterranean formation, the method comprising:

obtaining physical properties of the wellbore, the physical properties comprising one or more of density log, compressive and tensile rock strength, frictional strength of any discontinuity, wellbore path, position and type of wellbore failure, and mud weight;

calculating a first horizontal stress based on at least one of the physical properties based on an assumption of frictional forces in the earth;

calculating a second horizontal stress based on an assumption of a uniaxial elastic earth crust;

comparing the first horizontal stress with the second horizontal stress;

performing percentile filtering to assign a scaling factor;

calculating a third horizontal stress by applying the scaling factor based on both the assumption of the frictional forces and the assumption of the uniaxial elastic earth crust, the first horizontal stress, the second horizontal stress, and the third horizontal stress providing an optimum integrated solution for the principal horizontal stresses; and using the optimum integrated solution for the principal horizontal stresses to at least one of design or implement a hydraulic fracturing process in the subterranean formation.

2. The method of claim 1, wherein the first horizontal stress is estimated by a first algorithm that includes equation (1):

$$S_{Hmax} - \alpha P_p = S_{hmin} - \alpha P_p = (S_v - \alpha P_p)\left(\frac{v}{1-v}\right) \quad (1)$$

where $P_p$ is pore pressure, $\alpha$ is Biot's coefficient, $S_{H\ max}$ is maximum horizontal principal stress, $S_{h\ min}$ is minimum horizontal principal stress, and v is Poisson's ratio.

3. The method of claim 2, wherein the first algorithm includes a failure criterion selected from Mohr-Coulomb criterion, modified lade criterion, Drucker Prager criterion, and Hoek criterion.

4. The method of claim 2, wherein the second horizontal stress is calculated by a second algorithm that includes equation (2):

$$S_{Hmax} - \alpha P_p = \left(\frac{v}{1-v}\right)(S_v - \alpha P_p) + (S_y - \alpha P_p) \quad (2)$$

$$S_{hmin} - \alpha P_p = \left(\frac{v}{1-v}\right)(S_v - \alpha P_p) + (S_x - \alpha P_p)$$

where $S_y$ and $S_x$ are stress offsets due to tectonic movements in maximum and minimum horizontal stress directions respectively.

5. The method of claim 4, wherein the third horizontal stress is calculated by a third algorithm that integrates the first algorithm and the second algorithm, the third algorithm includes equation (3):

$$S_{Hmax} - \alpha P_p = \left(\frac{v}{1-v}\right)(S_v - \alpha P_p) + \frac{E}{(1-v^2)}(\varepsilon_H + v\varepsilon_h) \quad (3)$$

$$S_{hmin} - \alpha P_p = \left(\frac{v}{1-v}\right)(S_v - \alpha P_p) + \frac{E}{(1-v^2)}(\varepsilon_h + v\varepsilon_H)$$

where E is static Young's modulus, and $\varepsilon_H$ and $\varepsilon_h$ are tectonic strains in the maximum and minimum horizontal stress directions respectively.

6. A non-transitory machine-readable storage medium, which when executed by at least one processor of a computer, performs the steps of claim 1.

7. A method of calculating an optimum continuous stress solution along a wellbore into a subterranean formation, the method comprising:

estimating a vertical stress and sub-surface rock properties;

performing a continuous elastic stress solution based on a plain-strain elastic solution using sonic logs obtained from the wellbore;

performing a stationed frictional equilibrium solution at locations of compressive and tensile borehole failure;

performing a continuous stress solution including at least one of: defining polynomial functions based on co-existing solutions, or defining uniaxial compressive strength;

comparing results from the continuous stress solution with existing data to determine whether the optimum continuous stress solution has been reached to yield a comparison; and using the optimum continuous stress solution to at least one of design or implement a hydraulic fracturing process in the subterranean formation.

8. The method of claim 7, wherein the optimum continuous stress solution is reached when difference between the results from the continuous stress solution and the existing data is less than 10%.

9. The method of claim 7, further comprising: repeating the performance of the continuous stress solution and the comparison of the continuous stress solution to the existing data until the optimum continuous stress solution has been reached.

10. A non-transitory machine-readable storage medium which upon execution at least one processor of a computer to perform the steps of claim 7.

11. A method of determining stresses in a reservoir, the method comprising:

estimating one or more first horizontal stresses and sub-surface rock properties using friction equilibrium equations;

estimating one or more second horizontal stresses using uniaxial elasticity assumption equations;

comparing results of the one or more first horizontal stresses and the one or more second horizontal stresses to determine an effect of tectonic forces and local variations in stresses due to faults and discontinuities using a percentile filtering to estimate a scaling factor to provide an optimum integrated solution for horizontal stresses;

applying said scaling factor to obtain the optimum integrated solution for horizontal stresses; and using the optimum integrated solution for horizontal stresses to at least one or design or implement a hydraulic fracturing process in the reservoir.

12. The method of claim 11, wherein the optimum integrated solution for horizontal stresses uses:

$$S_H - \alpha P_p = k(S_v - \alpha P_p) + f1(\mathrm{UCS})$$

$$S_h - \alpha P_p = k(S_v - \alpha P_p) + f2(\mathrm{UCS}),$$

wherein functions $f1$ and $f2$ are independent, UCS is uniaxial compressive strength, Sv is vertical stress, and $P_p$ is pore pressure, $S_h$ is minimum horizontal stress, $S_H$ is maximum horizontal stress, $\alpha$ is Biot's coefficient and $$0 < k = \frac{v}{1-_v} < 1.$$

13. The method of claim 11, further comprising printing or displaying the optimum integrated solution for horizontal stresses.

14. A non-transitory machine-readable storage medium which upon execution at least one processor of a computer to perform the steps of claim 11.

* * * * *